United States Patent [19]

Lau

[11] Patent Number: 4,777,120

[45] Date of Patent: Oct. 11, 1988

[54] PHOTOGRAPHIC ELEMENT AND PROCESS COMPRISING A MASKING COUPLER

[75] Inventor: Philip T. S. Lau, Rochester, N.Y.

[73] Assignee: Eastman Kodak Company, Rochester, N.Y.

[21] Appl. No.: 50,811

[22] Filed: May 18, 1987

[51] Int. Cl.[4] ..... G03C 7/32; G03C 7/34; G03C 7/35; G03C 7/18

[52] U.S. Cl. ..... 430/359; 430/226; 430/543; 430/548; 430/553; 430/555; 430/557

[58] Field of Search ..... 430/359, 361, 548, 549, 430/553, 555, 557, 226, 543

[56] References Cited

U.S. PATENT DOCUMENTS

| | | | |
|---|---|---|---|
| 2,434,272 | 1/1948 | Jelley et al. | 430/379 |
| 2,449,966 | 9/1948 | Hanson | 430/359 |
| 2,455,169 | 11/1948 | Glass et al. | 430/385 |
| 2,808,329 | 10/1957 | Whitmore | 430/359 |
| 2,860,974 | 11/1958 | Williams | 430/361 |
| 4,555,477 | 11/1985 | Washburn | 430/359 |
| 4,555,478 | 11/1985 | Reczek et al. | 430/226 |

OTHER PUBLICATIONS

Research Disclosure, Dec. 1978, Item No. 17643—*Research Disclosure,* Emsworth Studios, Inc., New York, N.Y.

*Photographic Science and Engineering,* vol. 15, No. 3, May–Jun. 1971, pp. 262–267.

*Primary Examiner*—Richard L. Schilling

*Attorney, Agent, or Firm*—Richard E. Knapp

[57] ABSTRACT

A photographic masking coupler containing in the coupling position a coupling-off group that is capable of reacting with oxidized color developing agent to form a water-insoluble dye in non-image areas and a water-soluble compound in image areas of a color photographic element enables formation of a colored integral mask for color correction upon exposure and processing of the element. The masking couplers are essentially colorless in a color photographic element. Such a photographic masking coupler is advantageous in a color photographic element and process.

10 Claims, No Drawings

PHOTOGRAPHIC ELEMENT AND PROCESS COMPRISING A MASKING COUPLER

FIELD OF THE INVENTION

This invention relates to new photographic masking couplers and to photographic materials and processes utilizing such compounds.

DESCRIPTION OF THE STATE OF THE ART

The use of masking couplers in photographic elements to compensate for unwanted dye absorption is known in the photographic art.

One type of masking coupler has been an incorporated colored coupler containing an azo group connected to the coupler moiety at the coupling position. This is described, for example, in U.S. Pat. No. 2,455,169. The azo group in such couplers can be coupled off by oxidized color developer in the image areas and washed out of these areas during processing. Another type of known colored coupler contains an azo group which is ballasted and the azomethine dye formed upon coupling is soluble and can be washed out of the image areas. This is described in U.S. Pat. No. 2,808,329.

A further type of known masking coupler is in a blocked form and is nearly colorless until alkaline processing of the photographic element containing the coupler releases the colored form of the colored coupler. This is described in U.S. Pat. No. 2,860,974.

The problems with prior masking couplers have centered on the fact that they are (1) colored in the photographic element prior to and during imagewise exposure and result in undesired reduction in photographic speed or (2) involved added material cost or require added chemicals or steps to modify conventional photographic processing. Although numerous couplers are known, particularly masking couplers, a continuous search goes on for novel masking couplers which avoid the described problems and which improve, or optimize for particular applications, such properties of the coupler as stability, reactivity, and general compatibility with other components in the photographic element, and such properties of the resultant masking dye as efficient light absorption, stability and hue.

SUMMARY OF THE INVENTION

It has been found that this can be accomplished by means of a coupler, that is essentially colorless when incorporated in a color photographic element, and has a coupling-off group, such as a formyl-substituted coupling-off group, that is capable of reacting with color developing agent. The coupling-off group reacts with unoxidized developing agent to form a water-insoluble dye in non-image areas and a water-soluble compound capable of being washed out of the element in image areas. The coupler is capable of forming a colored integral mask for color correction upon exposure and processing of the photographic element. The coupling-off group is preferably an ortho-formyl aryloxy or ortho-formyl arylthio coupling-off group, such as an ortho-formyl phenoxy or ortho-formyl phenylthio coupling-off group.

This new class of couplers is characterized by its lack of color in a photographic silver halide element before exposure and processing and the formation of a masking dye during processing without the need for added processing steps or solutions.

A color photographic element of the invention comprises a support bearing at least one photographic silver halide emulsion layer and a masking coupler according to the invention. Such a photographic element can comprise, for example, a cyan image dye-forming coupler that enables formation of a cyan image dye upon exposure and processing by means of a color developer. The cyan image dye-forming coupler provides a cyan image dye with increasing density based on exposure of the photographic element. However, the image dye density can also provide undesired absorption in other regions of the spectrum, such as in the blue region of the spectrum. The masking coupler according to the invention can provide, upon exposure and processing of the element, a dye which does not undesirably absorb in the region of the spectrum in which the cyan image dye absorbs. However, the masking dye formed from the masking coupler according to the invention provides positive image absorption in the regions of the spectrum in which the image dye provides undesired negative image absorption. The net result is a more desired image color.

The masking coupler accordng to the invention is important in accomplishing this more desired image color. In order to accomplish this result, the coupling-off group of the coupler according to the invention (I) reacts with color developer (Dev) to form a water-soluble compound (II), which is then detached from the coupler moiety (COUP) by oxidized color developer ($D_{ox}$), produced as a function of exposure and processing in the image-forming regions of the photographic element. The water-soluble compound (II) is washed out of the photographic element during processing. The water-insoluble masking dye formed in the unexposed areas of the photographic element remains in the photographic element to accomplish its intended masking function.

An illustration of the reactions that occur in the photographic element upon exposure and color development are as follows:

I. unexposed areas:

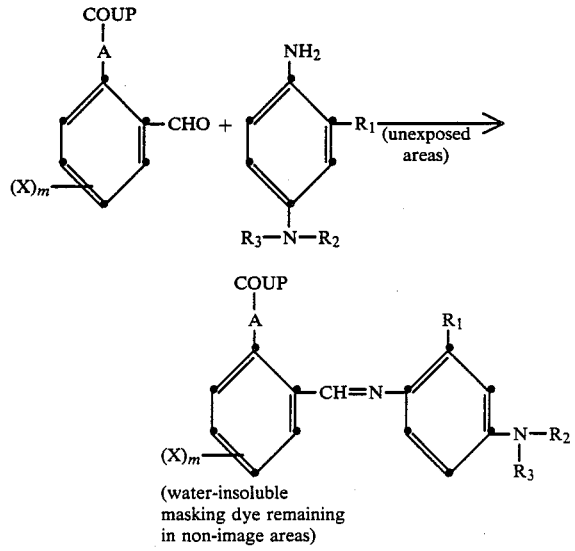

II. exposed areas:

-continued

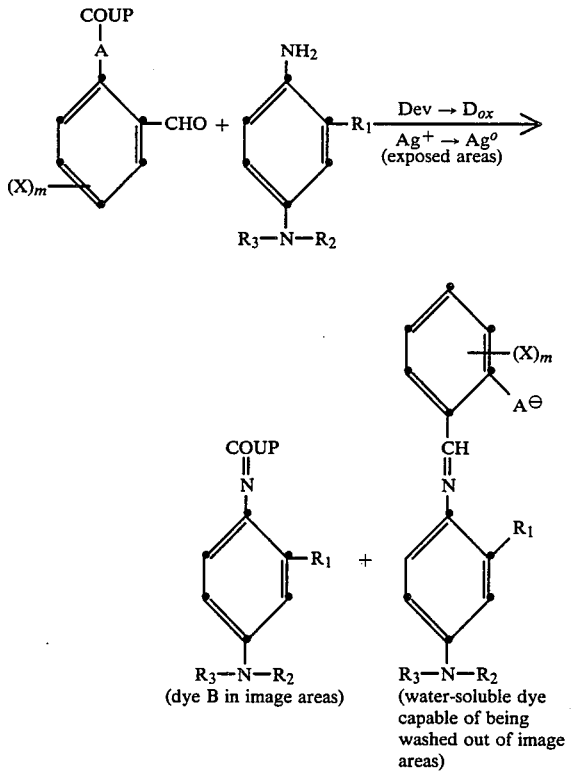

wherein:

COUP is a coupler moiety,

A is a divalent linking group, m is 1 or 2,

X is hydrogen or a substituent that does not adversely affect dye formation in the photographic element upon exposure and processing, $R_1$, $R_2$ and $R_3$ are individually hydrogen or a substituent that does not adversely affect dye formation in the photographic element upon exposure and processing, provided that at least one of $R_2$ and $R_3$ is a substituent.

The dye B in the image areas is preferably designed to match the hue of image dyes in the particular layer of the photographic element. Optionally, the dye B can be colorless or nearly colorless if COUP is selected to provide a colorless compound.

Preferred photographic couplers according to the invention capable of forming a masking dye are represented by the formula:

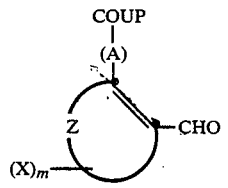

wherein

COUP is a coupler moiety containing the remainder of the molecule substituted in the coupling position, A is a divalent linking group, such as —O—, —S—, —$OCH_2$—, and —$SCH_2$—;

X is hydrogen or a substituent which does not adversely affect dye formation in a color photographic element containing said photographic coupler upon exposure and processing, such as $NO_2$, $COOR_4$, —$SO_2R_4$, $SO_2NHR_4$, Cl and Br wherein $R_4$ is alkyl or m is 1 or 2, Z represents the atom necessary to complete an aryl group, such as a phenyl or naphthyl group, or a heterocyclic group, particularly a 5 or 6 member heterocyclic group, such as an imidazole, pyrazole, pyrimidine, triazole, benzotriazole, oxazole or oxadiazole group.

The group A is preferably O or S and the group in the coupling position of COUP is preferably orthoformylaryloxy or arylthio. If desired, COUP can be bonded to A through a timing group (T) that enables timed release of the coupling-off group.

Examples of useful masking couplers according to the invention are as follows:

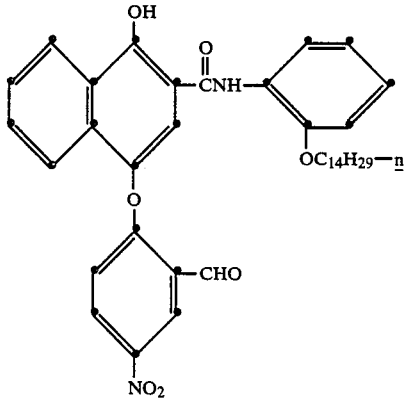

(1)

-continued
(2)
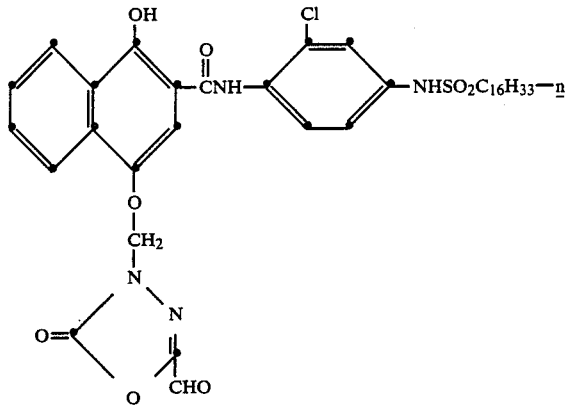
(3)
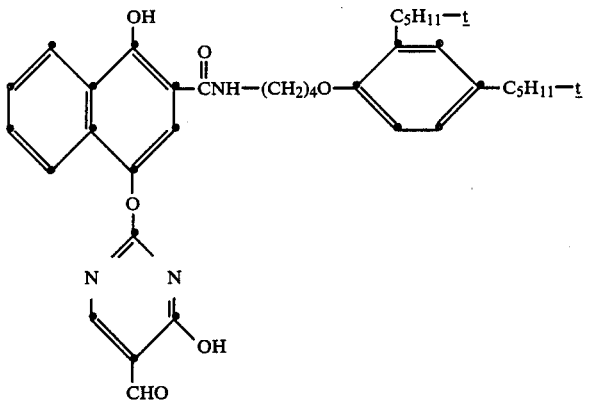
(4)
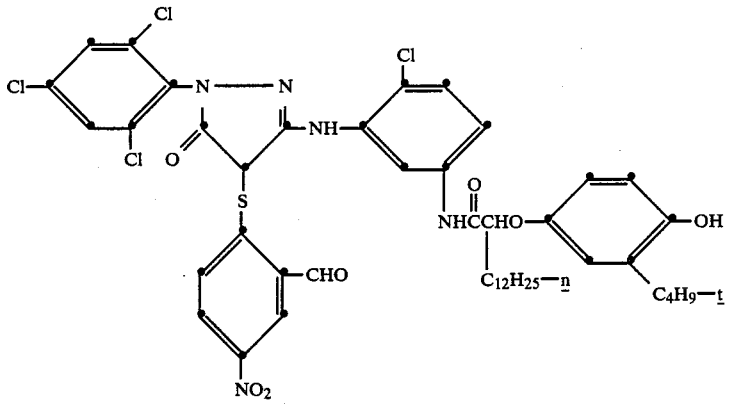
(5)
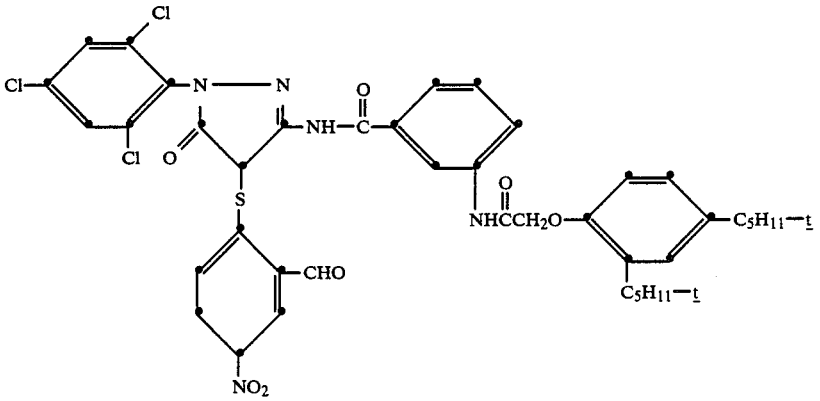

-continued
(6)
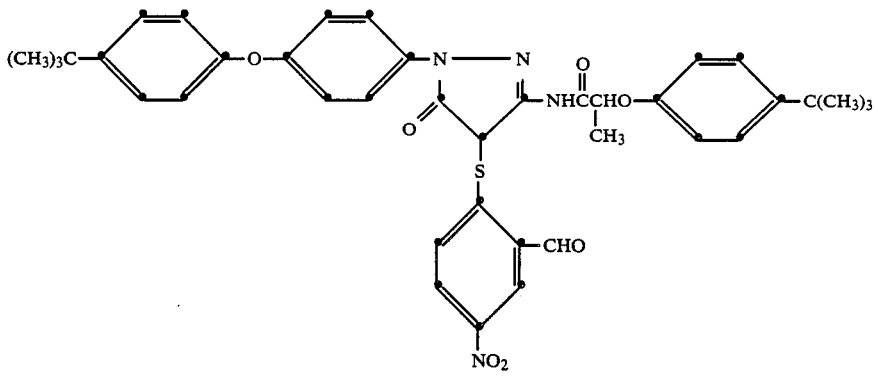
(7)
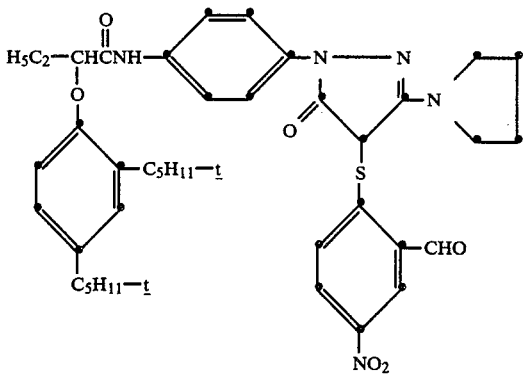
(8)
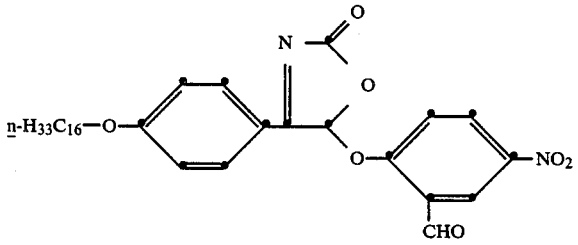
(9)
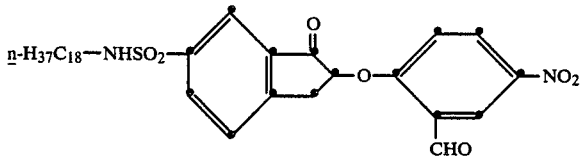
(10)
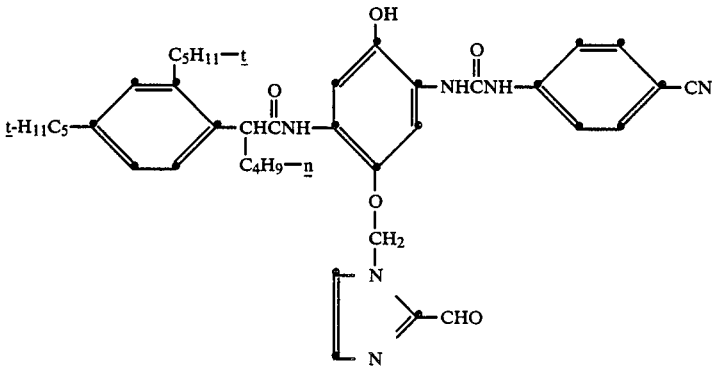

-continued
(11)
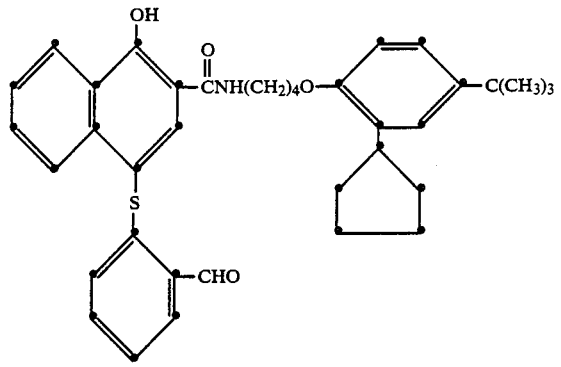
(12)
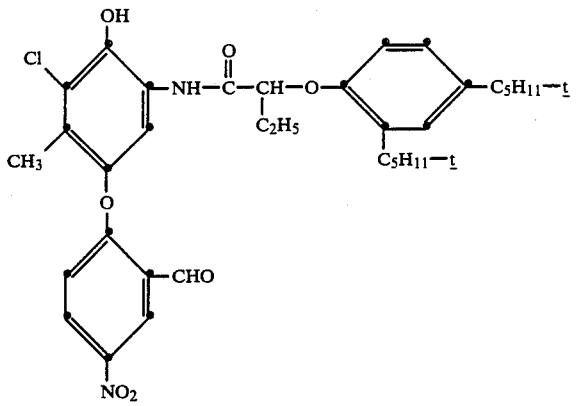
(13)
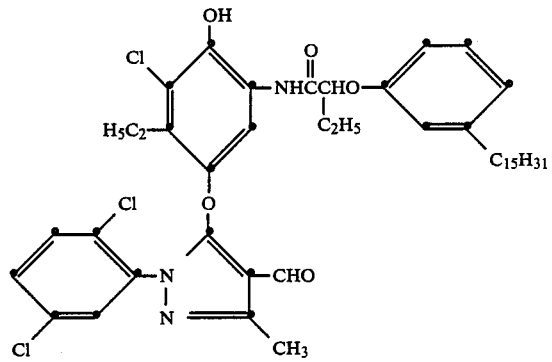
(14)
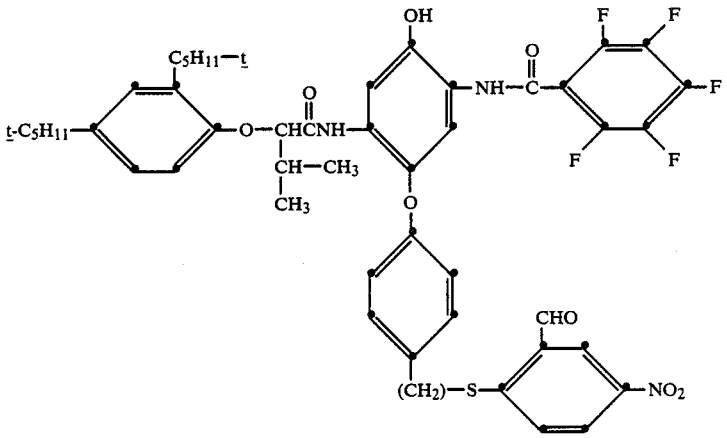

-continued
(15)
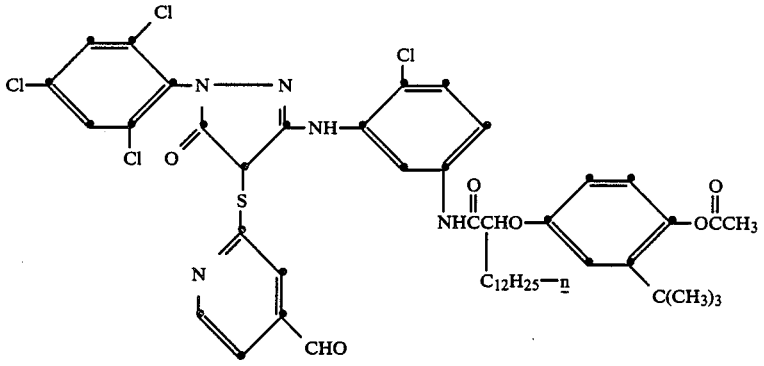
(16)
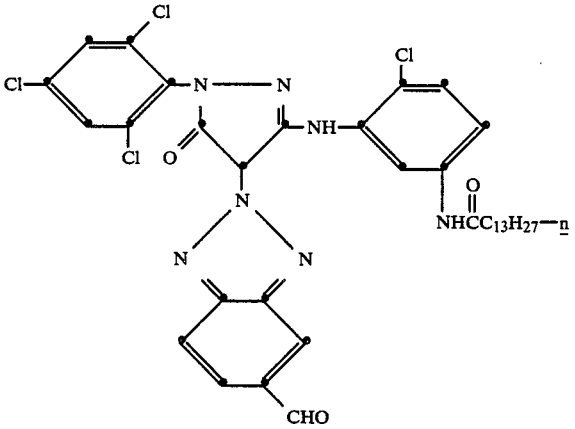
(17)
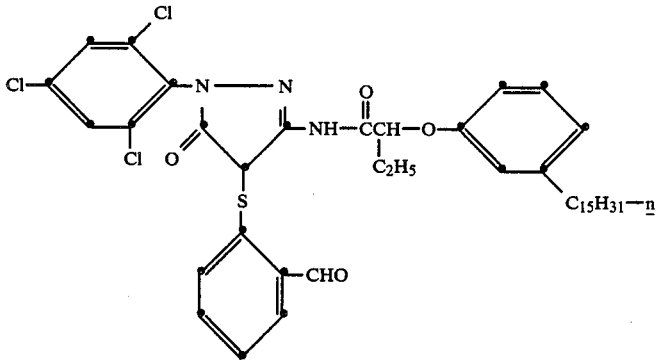
(18)
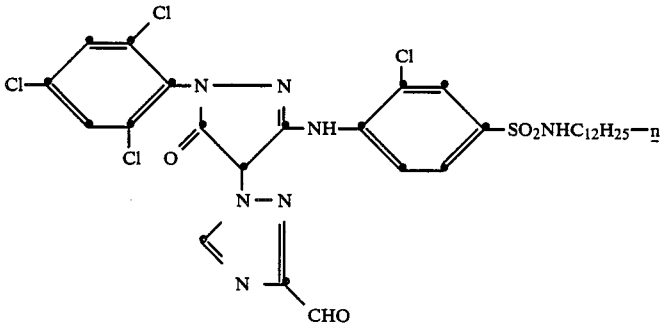

-continued
(19)
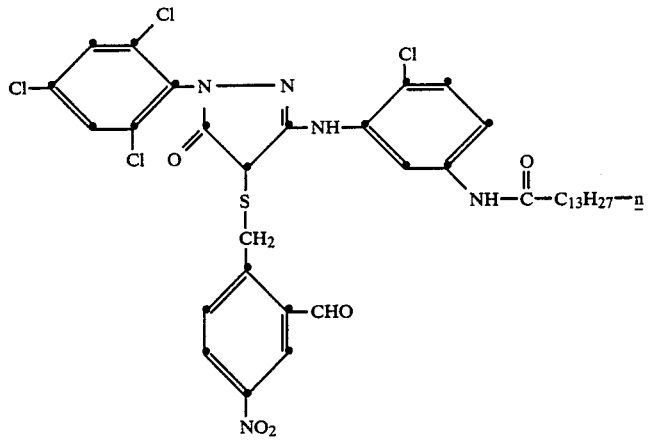
(20)
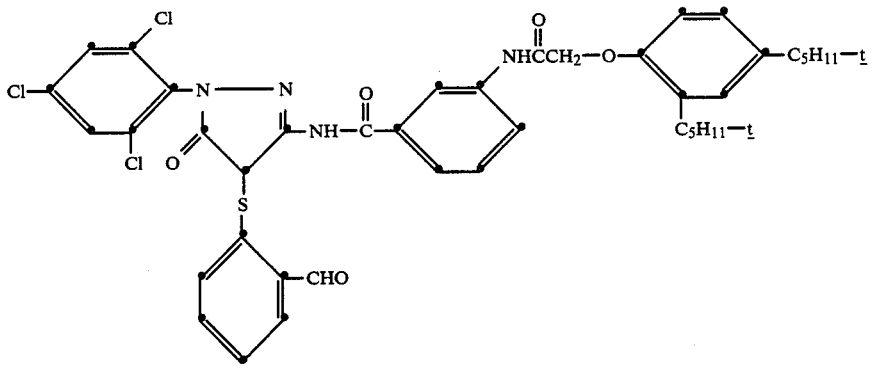
(21)
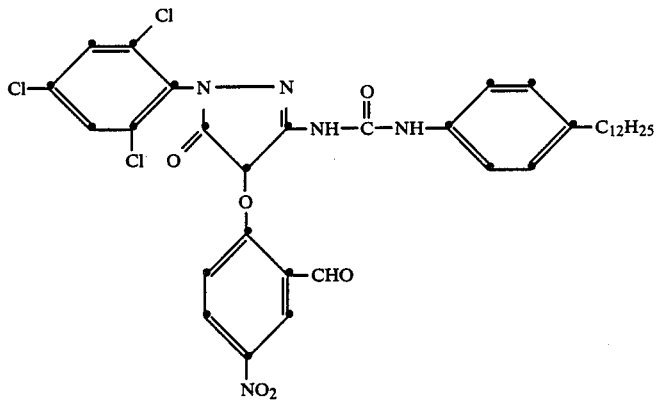
(22)
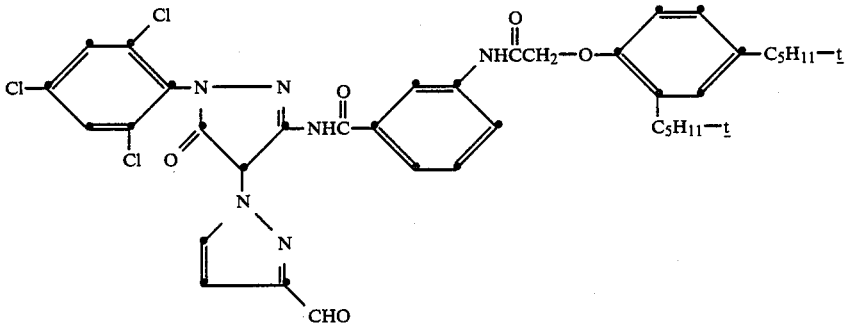

-continued (23)

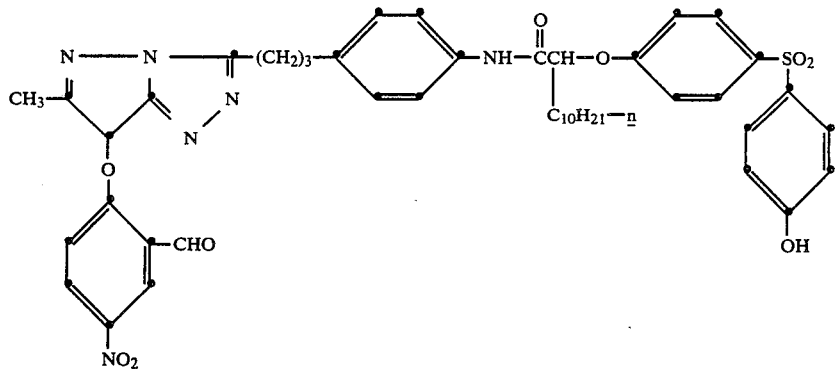

(24)

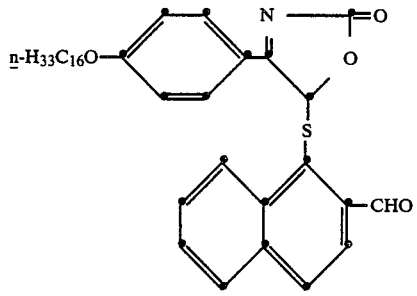

(25)

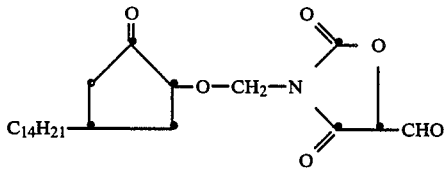

(26)

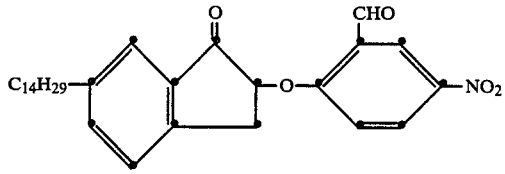

The new masking couplers according to the invention can be prepared from compounds and by methods known in the organic compound synthesis art. Examples of methods of synthesis of masking couplers according to the invention are as follows:

The phenolic and naphtholic couplers are prepared, for example, according to Scheme 1 as follows starting with the 4-hydroxy-substituted phenolic or naphtholic coupler Cp-OH.

Scheme 1

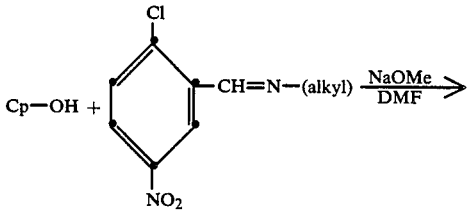

-continued

Scheme 1

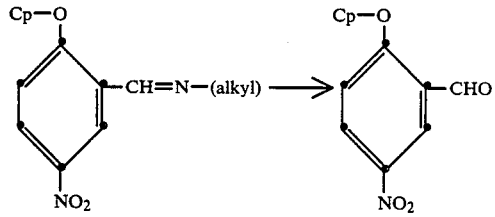

Me herein represents methyl.
DMF herein represents dimethylformamide.

Couplers that form essentially colorless coupling products can be prepared by Scheme 2 starting from halo-substituted coupler Cp-Cl wherein Cl is in the coupling position.

Scheme 2

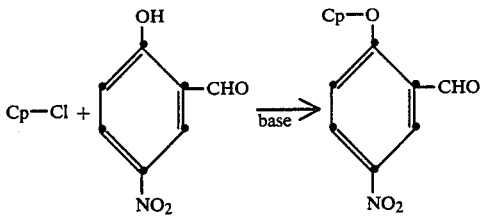

Magenta couplers can be prepared by Scheme 3 starting with four equivalent parent coupler CpH wherein H is in the coupling position.

Scheme 3

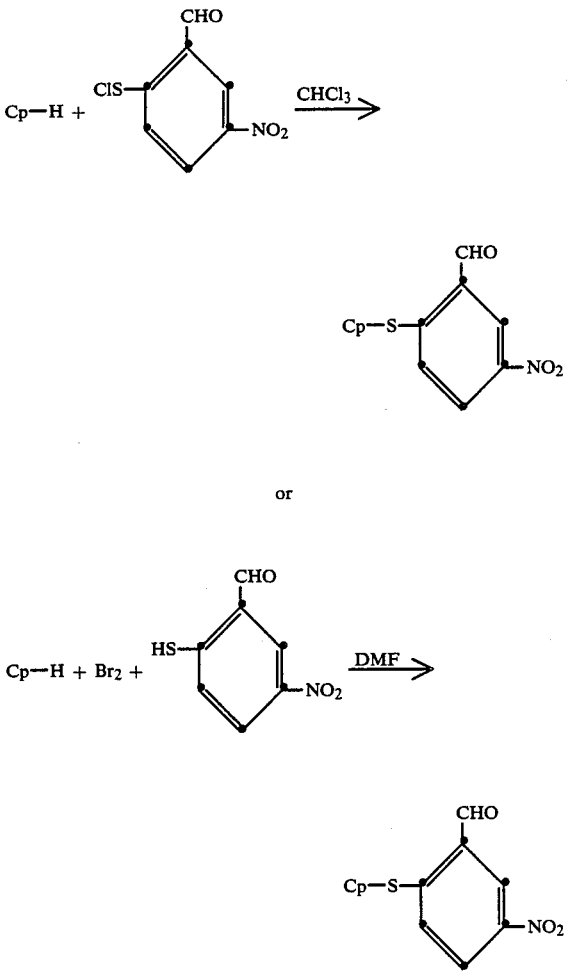

Representative examples of methods of preparing masking couplers according to the invention are as follows:

SYNTHESIS A

Preparation of 1-Hydroxy-4-(2-formyl-4-nitrophenoxy)-2-N-(2-tetradecyloxy)naphthanilide (Coupler 1)

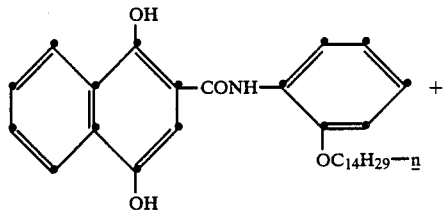

Compound A

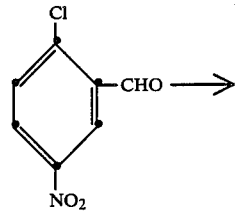

Compound B

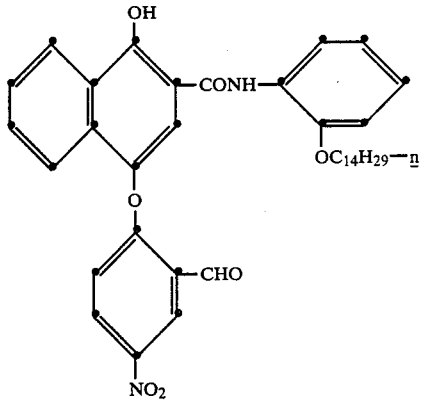

Coupler 1

A solution of 100 g (0.204 mol) Compound A in 250 ml dry dimethylformamide was added dropwise with cooling to 11.0 g of a 50 percent sodium hydride dispersion from which the mineral oil had been removed with hexane and replaced with 500 ml dimethylformamide cooled to 0° C. A solution of 37.9 g (0.204 mol) 2-chloro-5-nitrobenzaldehyde in 250 ml dimethylformamide was then added and stirring continued 30 minutes. To the mixture was added 1 liter ethylacetate and 1 liter water and the pH adjusted to about 3 or 4 with concentrated hydrochloric acid. The organic layer was separated, washed with water, dried over magnesium sulfate, concentarted, and chilled to yield solid Coupler 1. Recrystallization from ethyl acetate/hexane gave 82.2 g purified material, m.p. 118°-9° C., with the correct elemental analysis.

SYNTHESIS B

Preparation of 1-(2,4,6-trichlorophenyl)-3-[3-(2,4,-di-tert-pentylphenoxyacetamido)benzamido]-4-(2-formyl-4-nitrophenylthio)-5-pyrazolone (Coupler 5)

Compound D

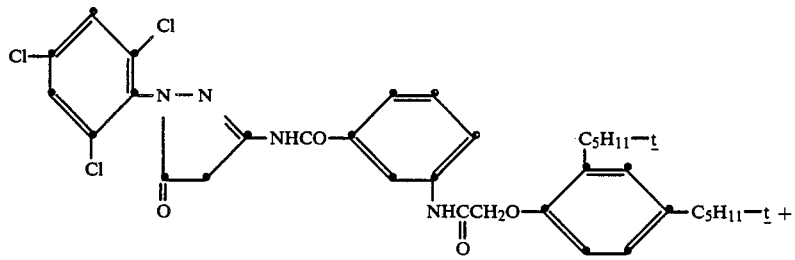

Compound E

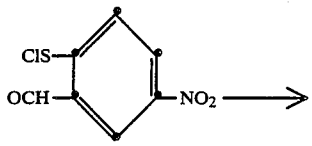

Coupler 5

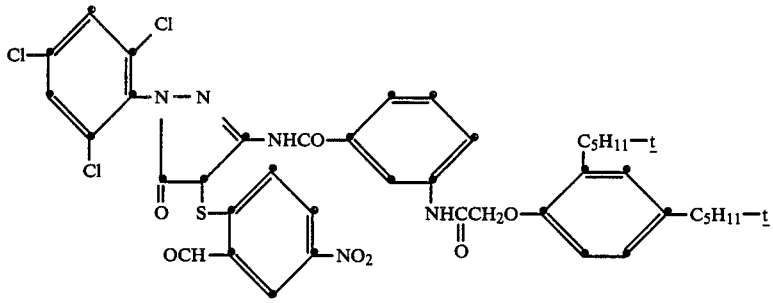

A slurry of 13.4 g (0.020 mol) Compound D in chloroform was treated with 5.0 g (0.023 mol) Compound E and the mixture refluxed for 5 hours. The solvent was removed by evaporation and the residual solid triturated with a sodium bicarbonate solution and washed with water to give 12.1 g solid Coupler 5. Recrystallization from ethyl acetate gave a pure sample, m.p. 154°-6° C.

A color photographic element according to the invention can comprise any image dye-forming couplers known in the photographic arts. Examples of useful image dye-forming couplers are described in, for example *Research Disclosure,* December 1978, Item No. 17643. The masking dye-forming coupler according to the invention can also form the image dye if desired. Combinations of masking couplers according to the invention are also useful.

As used herein, the terms "coupler" and "coupler compound" refer to the entire compound, including coupler moiety and the coupling-off group, while the term "coupler moiety" refers to that portion of the compound other than the coupling-off group.

As described, the masking couplers can contain a timing group between a coupler moiety and the linking group (A), the coupler moiety being joined to the timing group and the timing group being joined to the linking group so that upon reaction of the coupler with oxidized color developing agent the timing group, the linking group and the coupling-off group are released as a unit from the coupler moiety and thereafter the coupling-off group is released.

The coupler moiety can be any moiety which will react with oxidized color developing agent to release the coupling-off group. It includes coupler moieties employed in conventional color-forming couplers which yield colored products on reaction with oxidized color developing agents as well as coupler moieties which yield colorless products on reaction with oxidized color developing agents. Both types of coupler moieties are well known to those skilled in the art.

The coupler moiety can be unballasted or ballasted. It can be monomeric, or it can form part of a dimeric, oligomeric or polymeric coupler, in which case more than one coupling-off group can be contained in the coupler, or it can form part of a bis compound in which the coupling-off group forms part of a link between two coupler moieties.

It will be appreciated that, depending upon the particular coupler moiety, the particular color developing agent and the type of processing, the reaction product of the coupler moiety and the oxidized color developing agent can be: (1) colored and nondiffusible, in which case it will remain in the location where it is formed; (2) colored and diffusible, in which case it may be removed during processing from the location where it is formed or allowed to migrate to a different location; or (3) colorless and diffusible or nondiffusible, in which case it will not contribute to image density. In cases (2) and (3) the reaction product may be initially colored and/or nondiffusible but converted to colorless and/or diffusible products during the course of processing. In any of these cases, the masking dye formed must be in a location in the photographic element after processing which enables the masking dye to perform its intended masking function.

The coupling-off group is joined to the coupler moiety at any of the positions from which groups released from couplers by reaction with oxidized color developing agent can be attached.

In the formulas herein the COUP can be any coupler moiety known to be useful in the photographic art. In the formulas the coupling position can optionally contain a coupling-off group in the case of an image dye forming coupler. The coupling position substituent is represented by Y in the following structures, In the case of masking dye-forming couplers herein, Y in the formulas herein represents

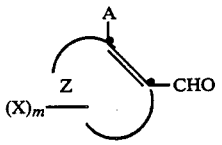

wherein A, m, Z and X are as defined above. Examples of useful COUP moieties are as follows:

I. COUP's

A. Couplers which form cyan dyes upon reaction with oxidized color developing agents are described in such representative patents and publications as: U.S. Pat. Nos. 2,722,162; 2,895,826; 3,002,836; 3,034,892; 2,474,293; 2,423,730; 2,367,531; 3,041,236; and "Farbkuppler-eine Literaturübersicht," published in Agfa Mitteilungen, Band III, pp. 156–175 (1961).

Preferably such couplers are phenols and naphthols which form cyan dyes on reaction with oxidized color developing agent and have the coupling-off group attached to the coupling position, thta is the carbon atom in the 4-position. Structures of preferred such coupler moieties are:

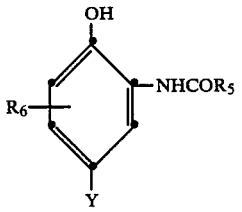

IA-1

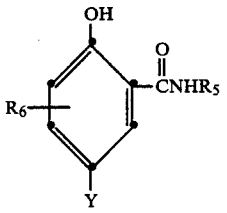

IA-2

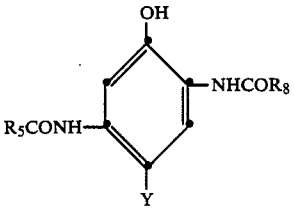

IA-3

-continued

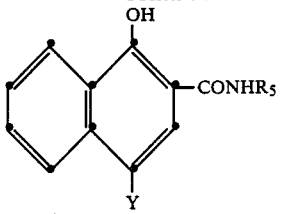

IA-4 wherein $R_5$ represents a ballast group, and $R_6$ represents one or more halogen (e.g. chloro, fluoro), lower alkyl (e.g methyl, ethyl, butyl) or lower alkoxy (e.g. methoxy, ethoxy, butoxy) groups;

$R_8$ represents substituted or unsubstituted aryl or substituted or unsubstituted arylamino groups. B. Couplers which form magenta dyes upon reaction with oxidized color developing agent are described in such representative patents and publications as: U.S. Pat. Nos. 2,600,788; 2,369,489; 2,343,703; 2,311,082; 3,152,896; 3,519,429; 3,062,653; 2,908,573; and "Farbkuppler-eine Literaturübersicht," published in Agfa Mitteilungen, Band III, pp. 126–156 (1961).

Preferably such couplers are pyrazolones and pyrazolotriazoles which form magenta dyes upon reaction with oxidized color developing agents and have the coupling-off group attached to the coupling position, i.e. the carbon atom in the 4-position or 7-position, respectively. Structures of preferred such coupler moieties are:

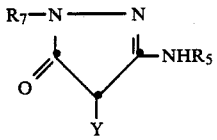

IB-1

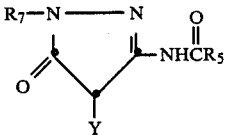

IB-2

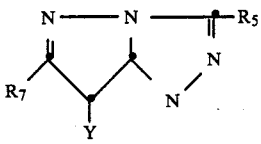

IB-3 wherein $R_5$ is as defined above, and $R_7$ is alkyl, such as methyl or butyl, or aryl, such as phenyl or substituted phenyl (e.g. 2,4,6-trihalophenyl).

C. Couplers which form yellow dyes upon reaction with oxidized color developing agent are described in such representative patents and publications as: U.S. Pat. Nos. 2,875,057; 2,407,210; 3,265,506; 2,298,443; 3,048,194; 3,447,928; and "Farbkuppler-eine Literaturü bersicht," published in Agfa Mitteilungen, Bant III, pp. 112–126 (1961).

Preferably such yellow dye-forming couplers are acylacetamides, such as benzoylacetanilides and pivalylacetanilides, and have the coupling-off group attached to the coupling position, i.e., the active methylene carbon atom.

Structures of preferred such coupler moieties are:

IC-1

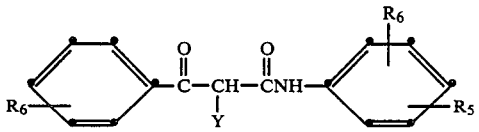

IC-2

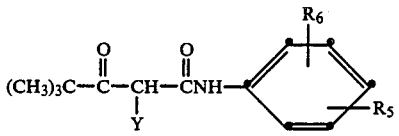

wherein $R_5$ is as defined above, and $R_6$ is hydrogen or one or more halogen, lower alkyl (e.g. methyl, ethyl) or ballast (e.g. alkoxy of 16 to 20 carbon atoms) groups.

D. Couplers which form colorless products upon reaction with oxidized color developing agent are described in such representative patents as: U.K. Pat. No. 861,138; U.S. Pat. Nos. 3,632,345; 3,928,041; 3,958,993; and 3,961,959. Preferably such couplers are cyclic carbonyl containing compounds which form colorless products on reaction with oxidized color developing agent and have the coupling-off group attached to the carbon atom in the α-position with respect to the carbonyl group.

Structures of preferred such coupler moieties are:

ID-1

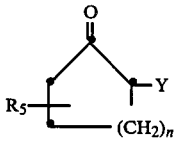

ID-2

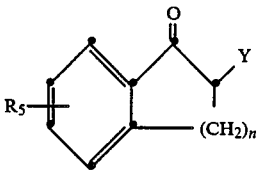

ID-3

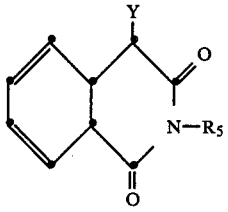

ID-4

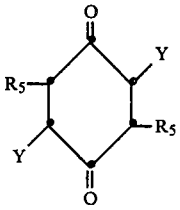

-continued

ID-5

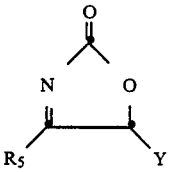

wherein $R_5$ is as defined above, and n is 1 or 2.

The coupler compounds are preferably nondiffusible, that is they should be of such molecular size and configuration that they will not significantly diffuse or wander from the layer in which they are coated.

Photographic elements of this invention can be processed by conventional techniques in which color forming couplers and color developing agents are incorporated in separate processing solutions or compositions or in the element.

Photographic elements in which the photographic couplers of this invention are incorporated can be simple elements comprising a support and a single silver halide emulsion layer or they can be multilayer, multicolor elements. The coupler compounds of this invention can be incorporated in the silver halide emulsion layer or in another layer, such as an adjacent layer, where they will come into reactive association with oxidized color developing agent which has developed silver halide in the emulsion layer. The silver halide emulsion layer can contain, or have associated with it, other photographic coupler compounds, such as color-forming couplers, other masking couplers, competing couplers, and image modifying couplers. These other photographic coupler compounds can form dyes of the same or different color and hue as the photographic coupler compounds of this invention. Additionally, the silver halide emulsion layer can contain addenda conventionally contained in such layers.

A typical multilayer, multicolor photographic element according to this invention can comprise a support having thereon a red-sensitive silver halide emulsion unit having associated therewith a cyan dye image providing material, a green-sensitive silver halide emulsion unit having associated therewith a magenta dye image providing material and a blue-sensitive silver halide emulsion unit having associated therewith a yellow dye image providing material, at least one of the silver halide emulsion units having associated therewith a coupler of the invention. Each silver halide emulsion unit can be composed of one or more layers and the various units and layers can be arranged in different locations with respect to one another. The coupler compounds of this invention can be incorporated in or associated with one or more layers or units of the element.

The light-sensitive silver halide emulsions can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide and mixtures thereof. The emulsions can be negative-working or direct-positive emulsions. They can form latent images predominantly on the surface of the silver halide grains or predominantly on the interior of the silver halide grains. They can be chemically and spectrally sensitized. The emulsions typically will be gelatin emulsions although other hydrophilic colloids can be used in accordance with usual practice. Tabular grain light-sensitive silver halide emulsions are particularly useful, such as described in *Research Disclosure,* January 1983, Item No. 22534 and U.S. Pat. No. 4,434,226.

The support can be any support used with photographic elements. Typical supports include cellulose nitrate film, cellulose acetate film, polyvinylacetal film, polyethylene terephthalate film, polycarbonate film and related films or resinous materials as well as glass, paper, metal and the like. Typically, a flexible support is employed, such as a polymeric film or paper support. Paper supports can be acetylated or coated with baryta and/or an α-olefin polymer, particularly a polymer of an α-olefin containing 2 to 10 carbon atoms such as polyethylene, polypropylene, ethylene-butene copolymers and the like.

The novel photographic masking couplers of this invention can be used in photographic elements in the same way as photographic couplers have previously been used in photographic elements.

Photographic elements of the invention or individual layers thereof can contain addenda known to be useful in color photographic elements, such as described in *Research Disclosure,* December 1978, Item No. 17643 published by Kenneth Mason Publications, Ltd., The Old Harbourmaster's, 8 North Street, Emsworth, Hampshire P0107DD, England. Such addenda include, for example, sensitizers, brighteners, antifoggants and stabilizers, antistain agents and dye stabilizers, light absorbing and screening materials, hardeners, plasticizers and lubricants, antistatic agents, matting agents, and development modifiers.

Photographic elements of the invention can be exposed and then processed to form a dye image and masking dyes by processing steps and processing compositions known in the photographic art. Processing to form a visible dye image and masking dye includes the step of contacting the element with a color developing agent. Oxidized color developing agent produced in this process reacts with the coupler to yield a dye image and masking dye. Another embodiment of the invention is a process of forming a photographic image which comprises developing an exposed photographic silver halide emulsion layer with a color developing agent in the presence of a photographic coupler wherein the photographic coupler contains in the coupling position a formyl-substituted coupling-off group and wherein the dye-forming coupler is capable of forming a colored integral mask for color correction upon exposure and processing of the emulsion layer.

With negative-working silver halide such processing leads to a negative image. To obtain a positive (or reversal) image, the color development step can be preceded by development with a non-chromogenic developing agent to develop exposed silver halide, but not form dye, and then uniformly fogging the element to render unexposed silver halide chromogenically developable. Optionally, a direct-positive silver halide emulsion can be useful to obtain a positive image.

Color development is typically followed by conventional steps of bleaching, fixing, or bleach-fixing, to remove silver and silver halide, washing and drying.

The following examples further illustrate the invention.

EXAMPLE 1

Photographic elements were prepared by coating a cellulose acetate-butyrate film support with a photosensitive layer containing a silver bromoiodide emulsion at 1.94 g Ag/m$^2$, gelatin at 2.69 g/m$^2$, and coupler dispersions at the levels indicated in Table 1. The photosensitive layer was overcoated with a layer containing gelatin at 1.08 g/m$^2$ and bis-vinylsulfonylmethyl ether at 1.75 weight percent based on total gelatin.

Samples of each element were exposed through a graduated-density test object and processed 2.25 minutes at 40° C. employing the following color developer solution:

| Color Developer Solution | |
|---|---|
| 4-amino-3-methyl-N—ethyl-N—β-hydroxyethylaniline sulfate | 3.55 g |
| Potassium sulfite | 29 g |
| Potassium carbonate (anhydrous) | 30.0 g |
| Potassium bromide | 1.25 g |
| Potassium iodide | 6.0 g |
| Water to 1 liter | |
| pH adjusted to 10.0 | |

Development was followed by the conventional bleaching, fixing, washing and drying steps. Comparison image coupler C-1 was used for comparison and has the following structure:

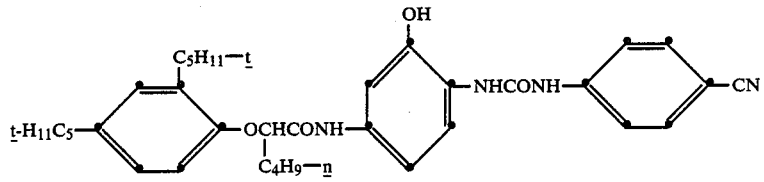

TABLE 1

| | | Color Densities to Red (R) or Blue (B) | | | | | | |
|---|---|---|---|---|---|---|---|---|
| Example No. | Ctg. | Couplers | mmole/m$^2$ | Color | $D_{min}$ | Mid | $D_{max}$ | ΔD |
| Example 1A | (a) | C-2 | 1.49 | R | 0.08 | 1.78 | 3.12 | 3.04 |
| (Comparison) | | — | — | B | 0.06 | 0.19 | 0.29 | 0.23 |
| 1B | (b) | 1 | 0.97 | R | 0.26 | 1.49 | 1.75 | 1.49 |
| (Invention) | | — | — | B | 0.82 | 0.56 | 0.37 | −.45 |
| 1C | (c) | C-2 | 1.49 | R | 0.15 | 1.83 | 3.80 | 3.65 |

TABLE 1-continued

| | | Color Densities to Red (R) or Blue (B) | | | | | | |
|---|---|---|---|---|---|---|---|---|
| Example No. | Ctg. | Couplers | mmole/m$^2$ | Color | $D_{min}$ | Mid | $D_{max}$ | ΔD |
| (Comparison) | | 1 | 0.32 | B | 0.55 | 0.62 | 0.56 | 0.01 |

$D_{min}$, Midscale, and $D_{max}$ densities were read with a Status M filter at steps 18, 13, and 2, respectively, produced from a 20 step 0-6 density wedge exposure.

$\Delta D = D_{max} - D_{min}$.

Dispersions contained coupler solvent dibutyl phthalate at a weight equal to the combined weight of couplers present.

It can be seen from Comparative Example 1A coating (a) of Table 1 that a cyan dye image is comprised not only of the desired scale in red density but also a smaller one in undesired blue absorption. In Example 1B coating (b) of a coupler of this invention has a reverse scale in blue density in addition to the desired red density scale so that a combination as in Example 1C coating (c), of the two couplers provides a red density scale and a nearly flat blue density scale. Thus, the undesired blue density image has been cancelled out, since a printer would read less difference between the $D_{min}$ and $D_{max}$ blue densities of a cyan image.

EXAMPLES 2-5

Masking results can be obtained by replacing the masking dye-forming coupler of Example 1 with one of the following masking dye-forming couplers:

Example 2
Coupler 6
Example 3
Coupler 7
Example 4
Coupler 8
Example 5
Coupler 9

The invention has been described in detail with particular reference to preferred embodiments thereof, but it will be understood that variations and modifications can be effected within the spirit and scope of the invention.

What is claimed is:

1. A color photographic element comprising a support bearing at least one photographic silver halide emulsion layer and a coupler, wherein the coupler is essentially colorless and has a formyl-substituted coupling-off group that, upon exposure and processing of the element, is capable of reacting with color developing agent to form a water-insoluble dye in non-image areas and a water-soluble compound capable of being washed out of the element in image areas.

2. A color photographic element as in claim 1 wherein the coupler is represented by the formula:

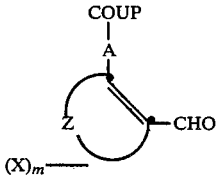

wherein

COUP is a coupler moiety containing the remainder of the molecule substituted in the coupling position, A is a divalent linking group, X is hydrogen or a substituent which does not adversely affect dye formation in the color photographic element upon exposure and processing, m is 1 or 2, and Z represents the atoms necessary to complete an aryl group.

3. A color photographic element as in claim 1 wherein the coupling-off group is an ortho-formyl aryloxy or arylthio coupling-off group.

4. A color photographic element as in claim 1 wherein the coupler is:

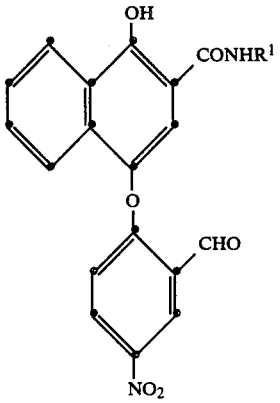

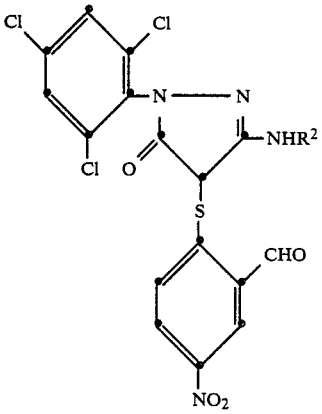

-continued

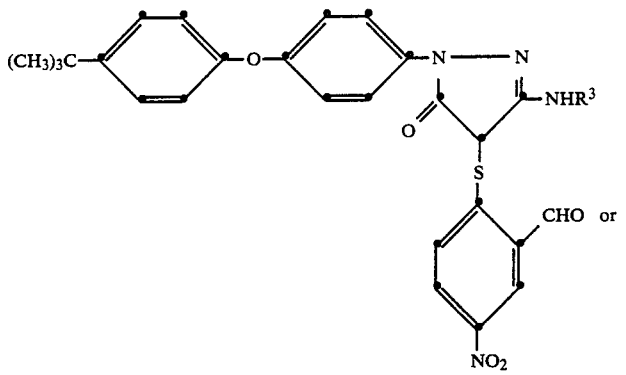

or

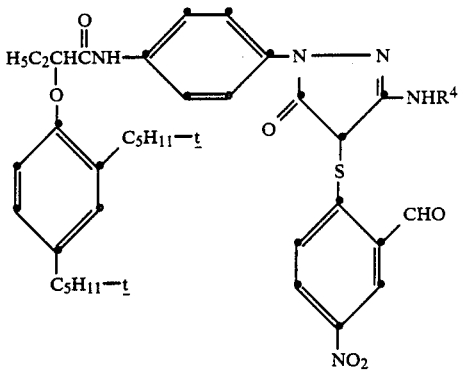

wherein $R^1$, $R^2$, $R^3$ and $R^4$ are individually atoms necessary to complete ballast groups.

5. A photographic element as in claim 1 wherein the coupler is a ballasted cyan dye-forming coupler.

6. A photographic element as in claim 1 wherein the coupler is a ballasted magenta dye-forming coupler.

7. A photographic element as in claim 1 comprising at least one red-sensitive photographic silver halide emulsion layer comprising a cyan dye-forming coupler, at least one green-sensitive photographic silver halide emulsion layer comprising a magenta dye-forming coupler and at least one blue-sensitive photographic silver halide emulsion layer comprising a yellow dye-forming layer.

8. A process of forming a color photographic image which comprises developing an exposed color photographic silver halide emulsion layer with a color developing agent in the presence of a photographic coupler wherein the photographic coupler is essentially colorless and has a formyl-substituted coupling-off group that, upon exposure and processing of the element, reacts with color developing agent to form a water-insoluble dye in the non-image areas and a water-soluble compound capable of being washed out of the element in image areas.

9. A process as in claim 8 wherein the coupler is represented by the formula

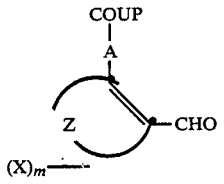

wherein

COUP is a coupler moiety containing the remainder of the molecule substituted in the coupling position, A is a divalent linking group, X is hydrogen or a substituent which does not adversely affect dye formation in the color photographic element upon exposure and processing, m is 1 or 2, and Z represents the atoms necessary to complete an aryl group.

10. A process as in claim 8 wherein the coupler is:

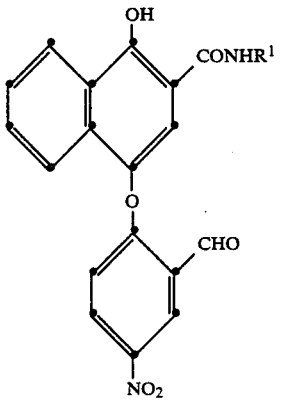

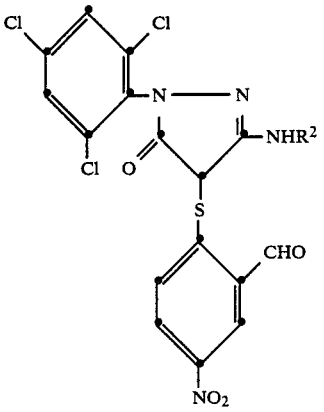

-continued
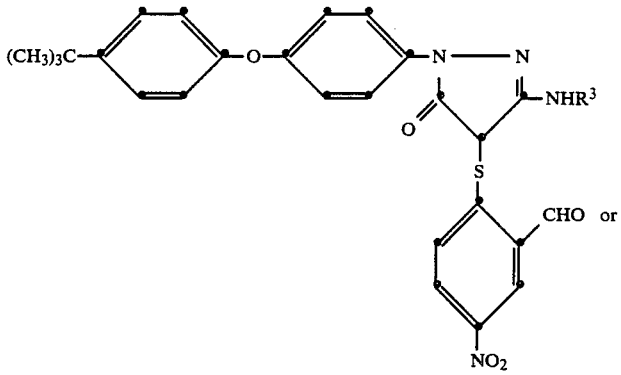
or
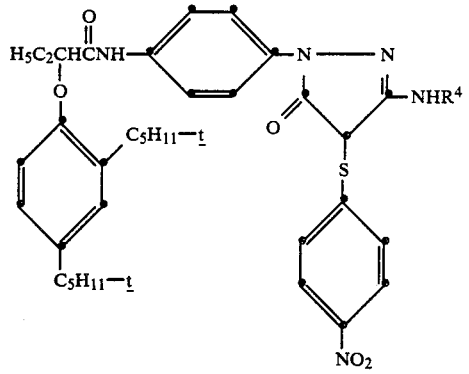
wherein
$R^1$, $R^2$, $R^3$ and $R^4$ are individually atoms necessary to complete ballast groups.
* * * * *

UNITED STATES PATENT AND TRADEMARK OFFICE

CERTIFICATE OF CORRECTION

PATENT NO. : 4,777,120

DATED : October 11, 1988

INVENTOR(S) : Philip T. S. Lau

It is certified that error appears in the above-identified patent and that said Letters Patent is hereby corrected as shown below:

Column 28, lines 24 - 30, the structure should read

--

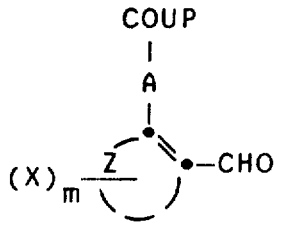

--

Column 30, lines 26 - 32, the structure should read

--

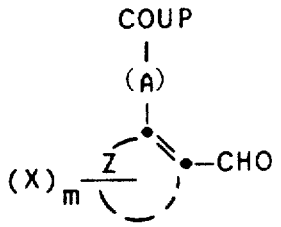

--

Signed and Sealed this

Third Day of October, 1989

*Attest:*

*Attesting Officer*

DONALD J. QUIGG

*Commissioner of Patents and Trademarks*